United States Patent [19]

Barlow

[11] Patent Number: 4,669,131

[45] Date of Patent: Jun. 2, 1987

[54] DRAIN ASSEMBLY AND PLUNGER COMPONENTS THEREFOR

[75] Inventor: J. Bruce Barlow, Glastonbury, Conn.

[73] Assignee: Macristy Industries, Inc., New Britain, Conn.

[21] Appl. No.: 805,774

[22] Filed: Dec. 6, 1985

[51] Int. Cl.[4] ..... E03C 1/24

[52] U.S. Cl. ..... 4/198; 4/199; 4/204

[58] Field of Search ..... 4/198–204, 4/374, 412, 413; 251/186, 195, 279

[56] References Cited

U.S. PATENT DOCUMENTS

| | | | |
|---|---|---|---|
| 1,056,352 | 3/1913 | Moore | 4/199 |
| 1,474,986 | 11/1923 | Watrous | 4/200 |
| 1,597,459 | 8/1926 | Muend | 4/200 |
| 1,901,118 | 3/1933 | Pope | 4/199 |
| 1,961,728 | 6/1934 | Arnest et al. | 220/3.7 |
| 2,122,620 | 7/1938 | Nystrom | 4/199 |
| 2,880,425 | 4/1959 | Lengyel | 4/199 |
| 3,307,206 | 3/1967 | Kreuger | 4/199 |
| 3,314,082 | 4/1967 | Minella | 4/204 |
| 4,454,614 | 6/1984 | Gustafsson et al. | 4/378 |
| 4,499,616 | 2/1985 | Johnson | 4/412 |

FOREIGN PATENT DOCUMENTS

| | | | |
|---|---|---|---|
| 1141572 | 9/1957 | France | 4/200 |
| 12663 | of 1891 | United Kingdom | 4/199 |

*Primary Examiner*—Henry K. Artis

[57] ABSTRACT

A drain operating member for a tub or like vessel includes an elongated shaft component having a plunger component on its lower end and a yoke portion on its upper end, the latter being provided with a series of longitudinally spaced apertures. The shaft component is constructed of a material that is relatively rigid and yet resiliently deflectable, to afford positive action to the plunger component while also facilitating installation and accommodating lateral movement produced by the lever. In preferred embodiments, the plunger component will comprise a plug for sealing engagement with an internal seat portion of the conduit assembly with which it is employed, and the shaft and plunger components will advantageously be integrally formed as a single piece. The operating member will preferably have a bifurcated yoke portion, and most desirably will be made from a readily severable material to permit facile alteration of its effective length.

12 Claims, 5 Drawing Figures

DRAIN ASSEMBLY AND PLUNGER COMPONENTS THEREFOR

BACKGROUND OF THE INVENTION

Waste and overflow mechanisms for controlling the valves of drain assemblies used for bathtubs and similar vessels commonly employ actuating means that is disposed in a position remote from the valve plug itself, connection therebetween being made through a suitable linkage arrangement. Typical mechanisms of that nature are disclosed in the following U.S. Pat. Nos. 1,901,118 to Pope; 1,901,649 to Huber; 2,871,487 to Fife; 3,656,188 to Thorp; 3,835,484 to Kato; 3,855,648 to Dunham; 3,860,977 to Politz; 4,194,252 to Tsuei; 4,352,213 to Watts; French Pat. No. 795,432 also shows a system of the same general type.

The linkage arrangement employed in such mechanisms frequently comprises metal rod components, loosely connected to one another; in such cases, positive action for seating the plug may not be possible, often resulting in seepage of water from the vessel past the plug. Arrangements employing parts that appear relatively rigid have been disclosed in the art, but difficulties of installation might be anticipated in connection with them.

Commercial waste and overflow systems of this type are commonly designed to permit variation in the effective lengths of conduit sections, to thereby enable installation in vessels having ports located at different positions. The operating mechanism used must of course also be of variable effective length, and difficulties have in the past been encountered in matching the operating mechanism length to that of the drain assembly; the above-mentioned patent to Watts addresses that problem. Despite the level of prior activity evidenced by the cited art, a need remains for a waste and overflow drain system in which positive action of the valve plug is afforded by means that is relatively simple and economical to produce, and which permits relatively facile and convenient installation.

Accordingly, it is an object of the present invention to provide a novel variable length operating member for a waste and overflow system, which is capable of producing positive action to effect closure of the valve, and which is relatively simple and economical to produce, and relatively facile and convenient to install.

It is a more specific object of the invention to provide such a member wherein alteration of its effective length is readily achieved.

Another object of the invention is to provide a novel waste and overflow system for a bathtub or similar vessel and incorporating such an operating member, the effective dimensions of which system are variable to permit installation in vessels having ports located at different positions.

SUMMARY OF THE INVENTION

It has now been found that certain of the foregoing and related objects of the invention are attained by the provision of a variable-length operating member for a waste and overflow system, comprised of an elongated shaft component fabricated from a relatively rigid and yet resiliently deflectable material, and a plunger component disposed on the lower end thereof. The upper end portion of the shaft component is formed with a series of longitudinally spaced apertures, which enable operative connection to actuating means for the system, and is readily severable for alteration of the effective length of the member. The relative rigidity of the shaft component affords positive operation of the plunger component in opposite directions, and its resilient deflectability facilitates installation as well as operation.

Generally, the shaft component will be made of a synthetic resinous material, and it and the plunger component will preferably be of one-piece, integrally formed construction. In certain embodiments the plunger component will have an imperforate sidewall portion, and will thereby be adapted to function as a plug for a passageway of the drain system in which the operating member is installed; most desirably, the sidewall portion of such a plunger component will be of circular cross section and formed with a slight downward taper.

The upper end portion of the shaft component will advantageously be bifurcated, to provide a pair of parallel legs adapted to receive a tang portion of the actuating means therebetween, the legs being formed with aligned holes arranged as a series of longitudinally spaced apertures. In some instances the plunger component will desirably be a separate part pivotably mounted upon the lower end of the shaft component, which may also be bifurcated to receive a mounting element thereof.

To adapt the operating member for use in connection with a relatively deep vessel, an elongated extension member may be assembled with it, the extension member having an upper end portion adapted for connection to an element of the actuating means and having a tongue portion on its lower end engaged between the legs of a shaft component upper end portion. The upper end portion of the extension member may also be bifurcated, with holes in its legs providing longitudinally spaced, laterally aligned apertures for effecting connection to the actuating means, and it too will desirably be fabricated from a relatively rigid, resiliently deflectable synthetic resinous material.

Other objects of the invention are attained by the provision of a waste and overflow system comprising, in combination, a drain conduit assembly, an actuating assembly, and an operating member having the features hereinbefore described. The conduit assembly thereof includes a first, generally rectilinear tubular portion, an elbow portion at one end of the first tubular portion which provides an offset access opening thereinto disposed laterally outwardly thereof, and a second tubular portion intersecting the first portion at a location spaced substantially from its "one" end. The actuating assembly comprises a mounting fixture, which is secured to the elbow portion of the conduit assembly with a portion of the fixture disposed over the access opening thereof, and an actuating lever mounted upon the fixture portion for pivotable movement about an axis perpendicular to the longitudinal axis of the first tubular portion. The actuating lever has a handle portion and a connecting portion, extending outwardly and inwardly of the fixture portion, respectively, and the connecting portion is engaged with one end portion of the elongated shaft component of the operating member. In preferred embodiments of the system, the "first" tubular portion of the conduit assembly will have a cylindrical passageway at its intersection with the "second" tubular portion, and the plunger component of the operating member will have an imperforate, generally cylindrical sidewall portion dimensioned and configured to sealingly engage therewithin.

DETAILED DESCRIPTION OF THE ILLUSTRATED EMBODIMENTS

Figure 1:
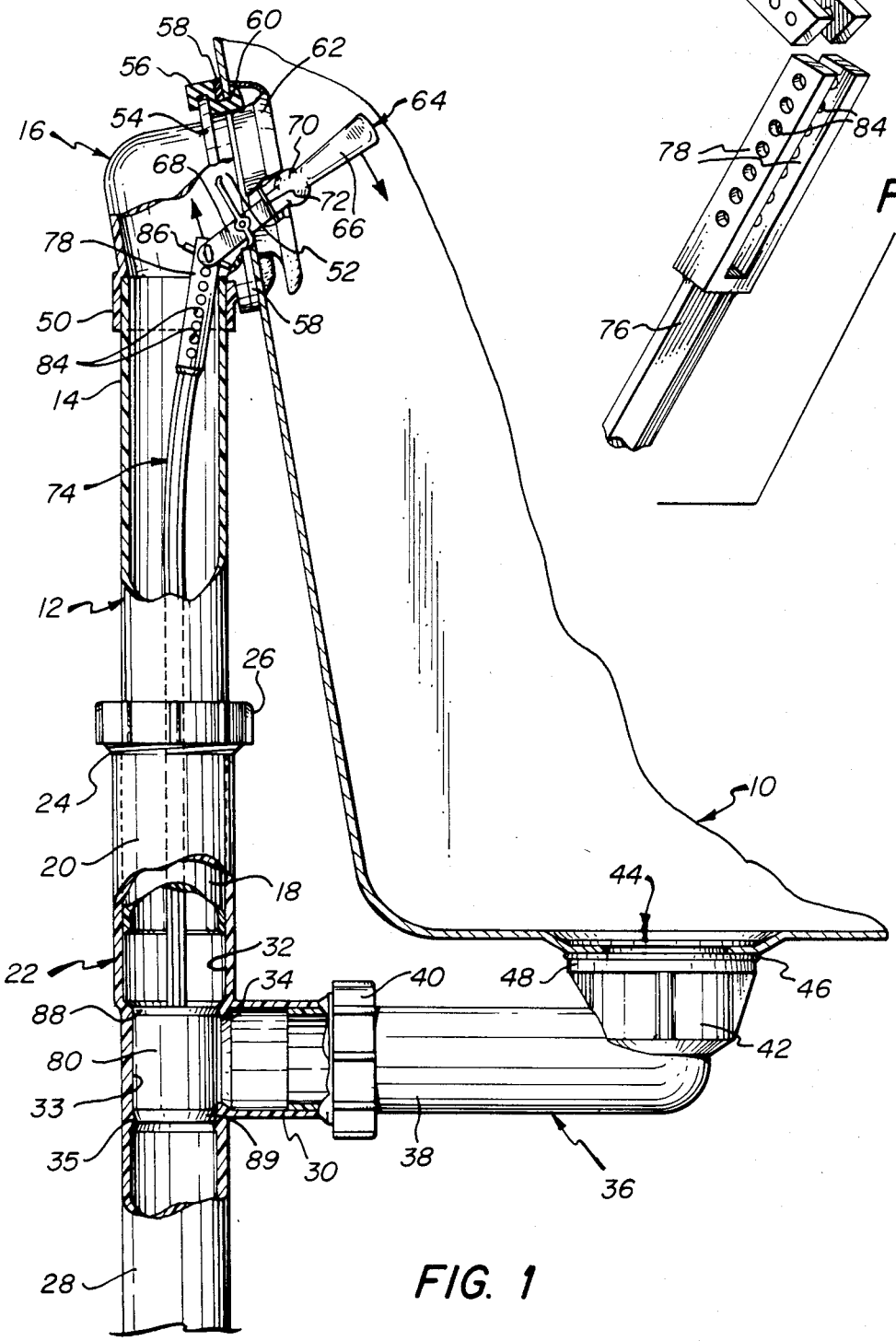
FIG. 1 is a fragmentary elevational view of a waste and overflow system embodying the present invention, installed in a bathtub and having portions broken away to show internal features.

Turning now in detail to the appended drawings, FIG. 1 shows a system embodying the present invention installed within a bathtub, generally designated by the numeral 10. The system includes a conduit assembly consisting of a first vertical tube, generally designated by the numeral 12, having affixed to its upper end 14 an overflow elbow, generally designated by the numeral 16, and having its lower end portion 18 telescopically received within an upwardly disposed section 20 of a tee fitting, generally designated by the numeral 22; as will be appreciated, the tubular components will normally be of polyvinyl chloride construction. The section 20 has a threaded upper end portion 24 on which is engaged a plastic slip-nut 26; as is conventional, a plastic washer (not visible) is disposed under the nut 26 and extends into the space between the adjacent surfaces, so that tightening of the nut 26 produces a water-tight seal between the mating tubular parts and secures them in relative position.

The lower section 28 of the tee fitting 22 will normally be connected to a tail piece (not shown), and thereby to the waste discharge system for the premises. A short tubular connecting arm 30 of the tee fitting projects laterally from a location between the upper and lower sections 20, 28, and communicates with the vertical flow passage 32 through a port 34 at the intersection therebetween. As will be noted, the throat section 33 of the flow passage 32 at that location is of reduced, generally circular cross section, and is tapered slightly in the downward direction; the wall of the fixture is thickened to form a circumferential internal shoulder element 35 at the lower end thereof.

A waste shoe, generally designated by the numeral 36, has a tubular portion 38 telescopically engaged within the arm 30 of the tee fitting 22, and is affixed in position by a slip-nut 40 and internal washer (not shown), as described above. An upwardly directed housing portion 42 is formed on the opposite end of the shoe 36, and a strainer member, generally designated by the numeral 44, is seated therewithin with its flange portion (the only part visible in the Figure) disposed against the inside surface of the tub 10, and with its body portion extending through the drain opening thereof (not shown); a washer 46 provides a seal between an upper annular flange element 48 of the housing portion 42 and the outside surface of the tub 10.

The overflow elbow 16 has a collar portion 50 thereon, within which the upper end 14 of the tube 12 is secured (such as by adhesive bonding). At the opposite end of the elbow 16, circumferentially extending flange structure 54 is provided for mounting a set of washers 56, 58. The washer 56 extends about and grips the flange structure 54, and passes through the overflow opening 60 of the tub 10, thereby defining a laterally directed access opening 52 for the conduit assembly; the washer 58 is of annular form, and is disposed between the washer 56 and the outside surface of the tub 10.

Overflow or escutchean plate 62 is mounted against the inside surface of the tub by screws (not shown), which pass therethrough and are engaged within the flange structure 54, and it has a centrally disposed opening (unnumbered) therein through which extends an actuating trip lever, generally designated by the numeral 64. The lever has an external handle portion 66, an internal tang portion 68, and an enlarged spherical portion 70 therebetween, the latter serving to prevent inward displacement. A U-shaped spring clip 72 is engaged upon the tang portion 68 to maintain the lever 64 in assembly with the escutchean plate 62 while also providing biasing force to maintain the lever in both of its extreme positions. It does so by acting against either of two faces of a pair of triangular bosses (not shown) which project from the inside surface of the plate 62 on opposite sides of its opening.

Figure 3:
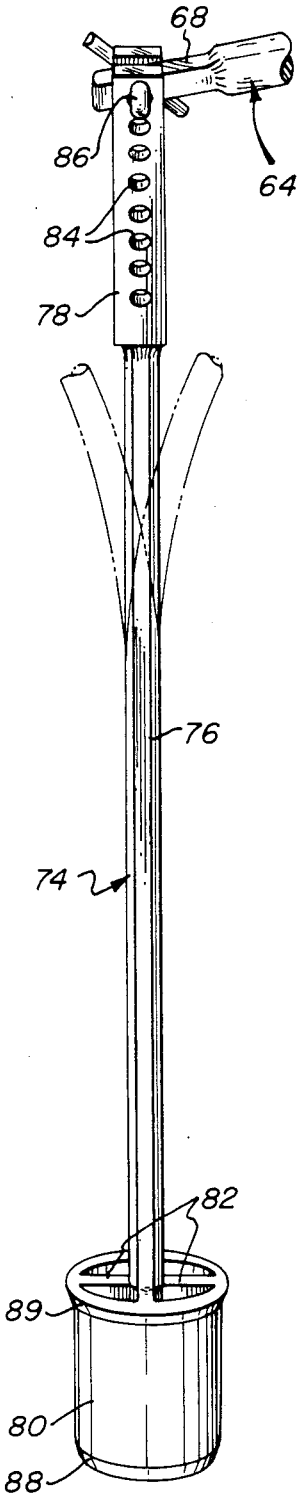
FIG. 3 is a perspective view of a one-piece operating member embodying the invention, connected to a fragmentarily illustrated actuating lever and showing (in phantom line) deflection of the shaft component from its normal (full line) condition.
Figure 5:
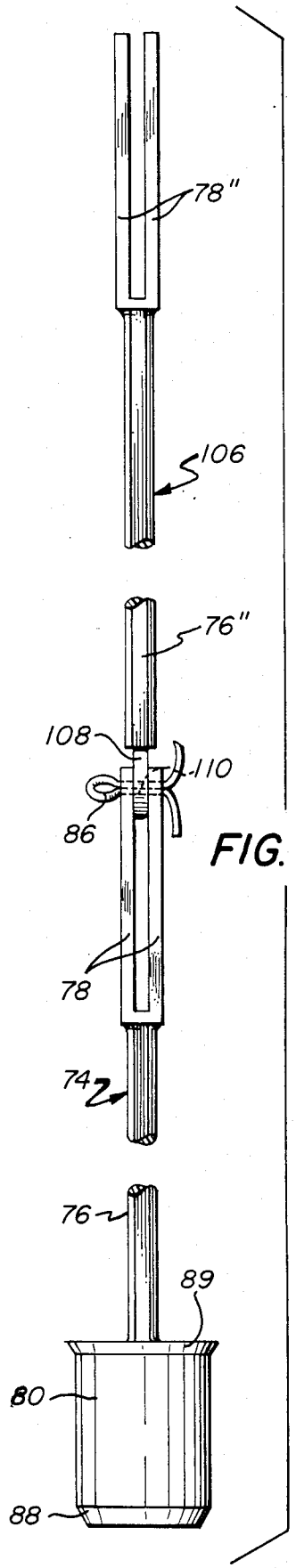
FIG. 5 is a fragmentary elevational view of an operating assembly comprised of an extension member attached to a one-piece operating member of the type shown in FIGS. 1 and 3.

Disposed within the conduit assembly is an operating plunger member, generally designated by the numeral 74 and shown in greater detail in FIGS. 3 and 5. The plunger member is of one-piece construction, and is normally integrally formed from a synthetic resinous material, such as polyethylene. It consists of a long, rectilinear shaft component 76, a bifurcated clevis or yoke portion comprised of parallel legs 78 at its upper end, and a plug component comprised of a generally cylindrical wall element 80 supported on the bottom of the shaft component 76 by four radial rib elements 82. A longitudinally extending series of equidistantly spaced holes 84 are provided in each leg 78 of the yoke portion, the holes in the two legs being laterally aligned with one another to enable insertion of a fastening member, such as cotter pin 86. The cotter pin also passes through an aligned hole (not seen) in the end of the tang element 68 of the actuating lever 64, disposed between the legs 78, to connect the lever to the plunger member 74, as shown in FIGS. 1 and 3. It will be noted that the wall element 80 is slightly tapered in the downward direction, and that the lower edge 88 and the upper shoulder element 89 thereon are both bevelled, to seat snugly upon the corresponding surfaces provided within the tee fixture 22, in the closed condition of the system (as is also shown in FIG. 1), and thereby to block the flow of water from the tub 10 through the port 34.

The operating plunger member 74 is of course displaced from its closed position simply by pivoting the trip lever 64 to move the handle portion 66 in a downward direction (as indicated by the arrow), lifting the plug component away from the seating surfaces of the tee fitting, and thus permitting water to drain from the tub 10 through the waste shoe 36. As will be appreciated, in shifting between the open and closed positions the tang portion 68 of the lever 64 necessarily moves through an arc; the inherent flexibility of the shaft component 76 of the plunger member permits it to bend as necessary (as indicated in FIG. 1) to accommodate the lateral variation in position that occurs at the point of connection. It will also be appreciated that the flexability of the plunger member shaft will greatly facilitate its introduction into the installed conduit assembly, through the offset access opening 52 of the elbow 16, despite the absence of any joints along the length of the member.

Figure 2:
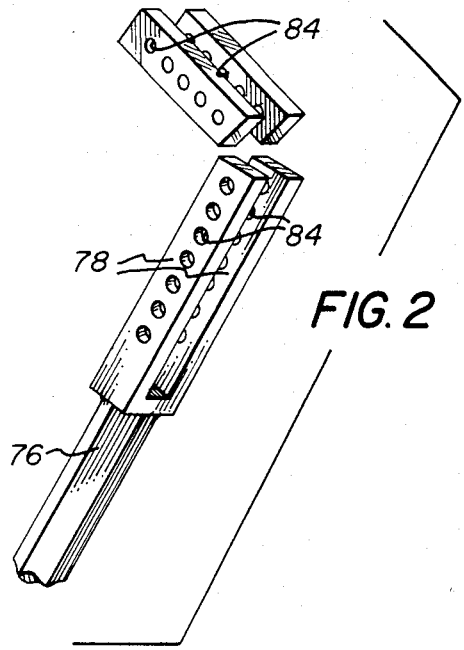
FIG. 2 is an enlarged, fragmentary perspective view of the bifurcated upper end portion of the shaft component of the operating member employed in the system, illustrating the manner in which the two legs may be severed to reduce its effective length.

The parts of the conduit assembly are of course of variable effective length to enable installation in a variety of tubs having overflow and drain ports in different relative positions, and the effective length of the plunger member must therefore be capable of similar alteration. This is conveniently achieved simply by severing the legs 76 of the yoke portion at an appropriate level, as depicted in FIG. 2; therefore, the material of which the member is constructed will normally be selected to permit facile severance, such as by cutting with a knife or the like.

The particular location at which the legs are cut will of course depend upon the spacing (as installed) between the access opening 52 of the overflow elbow 16 and the throat portion 33 of the tee fitting 22, which will in turn depend upon the ultimate position of the tube 12 with respect thereto. Various arrangements have been proposed for effectively transferring this dimension from the conduit assembly to the plunger member 74. For example, corresponding embossed or printed legends may be provided on the legs of the yoke portion and on the telescoping tube, or a simple template arrangement might be incorporated into the product packaging, by which a measurement can be transferred from the tubing to the plunger member.

Figure 4:
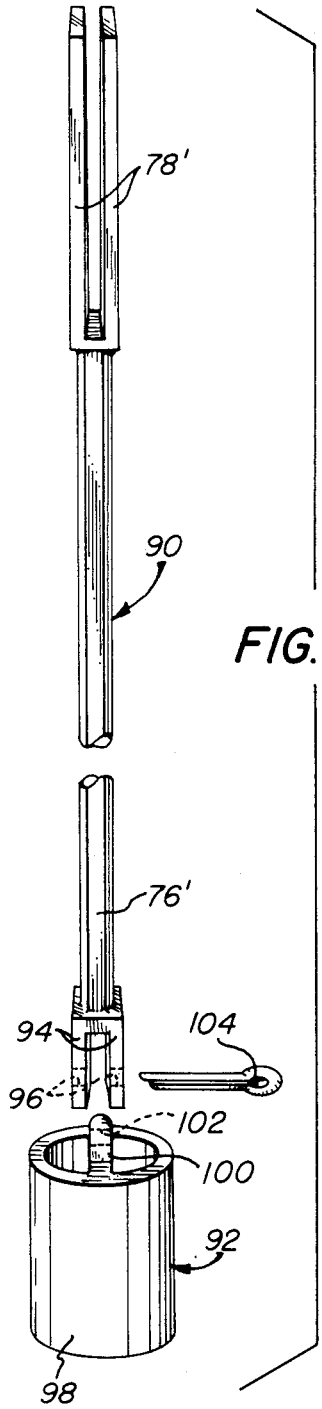
FIG. 4 is an exploded perspective view of a second form of the operating members embodying the present invention.

Turning now to FIG. 4, a second form of operating plunger members emboding the invention is illustrated, and consists of separate shaft and plunger components, generally designated by the numerals 90 and 92, respectively. As in the plunger member 74, the shaft component 90 has a shaft portion 76' with a bifurcated yoke portion at its upper end comprised of parallel legs 78'; the component 90 is of one-piece construction, and is made to be resiliently deflectable, such as by molding it of a suitable plastic material. The lower end of the shaft portion 76' is bifurcated as well, to provide relatively short parallel legs 94 in which are formed aligned transverse holes 96.

The plunger component 92 is in the form of a drop cylinder, and has a cylindrical sidewall 98 across which extends a bar with an upstanding ear element 100, which in turn has an aperture 102 extending through it. The plunger component 92 is pivotally joined to the shaft component 90 by inserting the ear element 100 between the legs 94, and securing the pieces with a cotter pin 104. As will be appreciated, the construction of FIG. 4 may be preferred in certain instances, such as when it is desired to use a plunger component made of brass or other metal. In other respects, the assembly will afford the same advantages as are provided by the construction previously described in detail.

Referring finally to FIG. 5, as illustrated therein plunger member 74 is assembly with an extension member, generally designated by the numeral 106 and fabricated from a resiliently deflectable material. The member 106 has a bifurcated upper end portion comprised of parallel legs 78" which, like the corresponding portions of the members 74 and 90, is formed with a series of apertures to permit assembly with the operating lever, and is constructed to enable facile foreshortening for length reduction. The lower end of the shaft portion 76" is formed with a tongue element 108, which is engaged between the legs 78 of the plunger member 74 and has a hole 110 formed through it to receive the cotter pin 86, by which the two parts are pivotably joined to one another. This will enable use of the operating plunger member in relatively deep vessel installations, such as tubs of the so-called "Roman style", wherein extra length is required to extend between the access opening of the elbow and the throat portion of the tee fitting. As will be appreciated, additional length adjustment capability is afforded by the assembly, due to the possibility of severing the bifurcated yoke of either the extension member 106 or the plunger member 74, or both.

Although the plunger components hereinabove described have sidewall portions 80, 98 for sealingly engaging the internal seating surfaces of the throat portions 33 of the tee fixture, it may in some instances be desirable to so construct it as to function only as a coupling piece, with the plunger member itself serving as a trip lever linkage in a so-called "pop-up" waste discharge arrangement. In such an assembly, the plug closure is disposed in the drain opening of the vessel, rather than functioning within the tee fitting, and is operated through suitable linkages. More particularly, the plunger component may be formed with a transverse passage in which is engaged a free end of an operating lever, the opposite end thereof being pivotably connected to a rocker arm disposed within the waste shoe, which is in turn operatively connected to the drain opening plug. Once again, the assembly described offers the advantages of positive opening and closing action, ease of installation, and facility of operation.

Thus, it can be seen that the present invention provides a novel variable length operating member for a waste and overflow system, which is capable of producing positive action to effect closure of the valve, which is relatively simple and economical to produce and relatively facile and convenient to install, and in which length alteration is readily achieved. The invention provides a novel waste and overflow system, the effective dimensions of which are variable to permit installation in bathtubs and similar vessels having ports located at different positions.

Having thus described the invention, what is claimed is:

1. A variable length operating member for the waste and overflow system of a tub or like vessel, comprising: an elongated shaft component having an upper end portion with a series of apertures spaced axially thereof to provide means for operative connection to actuating means; and a plunger component integrally formed and coaxial with the lower end of said shaft component, said shaft component being relatively rigid for positive actuation of said plunger component in opposite directions thereby while also being resiliently deflectable for facile installation and operation, said shaft and plunger components being integrally formed from synthetic resin, said upper end portion of said shaft component being readily severable along the length of said series of apertures therein for facile variation of the effective length of said shaft component, said plunger component having an imperforate sidewall portion adapting it to function as a plug for a passageway of the waste and overflow system.

2. The member of claim 1 wherein said sidewall portion of said plunger component is of circular cross-section and is formed with a slight downward taper.

3. The member of claim 1 wherein said upper end portion of said shaft component is bifurcated to provide a pair of parallel legs adapted to receive a tang portion of actuating means therebetween, said legs having aligned holes therethrough providing said series of spaced apertures.

4. A waste and overflow system for a tub or like vessel comprising: a drain conduit assembly, including a first, generally rectilinear tubular portion, an elbow portion at one end of said first portion providing an offset access opening thereinto disposed laterally outwardly thereof, and a second tubular portion intersecting said first tubular portion at a location spaced substantially from said one end thereof to provide a flow opening thereto; an actuating assembly including a mounting fixture secured to said elbow portion of said conduit assembly with a portion thereof disposed over said access opening, and an actuating lever mounted upon said fixture portion for pivotable movement about an axis perpendicular to the longitudinal axis of said first tubular portion, said actuating lever having a handle portion and a connecting portion extending outwardly and inwardly of said fixture portion, respectively; and an operating member, including an elongated shaft component having one end portion connected to said lever connecting portion, and a plunger component coaxially secured to the opposite end of said shaft component at said intersection of said first and second tubular portions and slidable within said first tubular portion, said plunger component being dimensioned and configured to close the opening at the intersection between said first and second tubular portions; said shaft component being relatively rigid for positive operation of said plunger component in opposite directions thereby to move said plunger relative to said intersection and block or open said opening while also being resiliently deflectable to facilitate insertion into said first tubular portion through said access opening and to enable lateral flexure to accommodate such pivotable movement of said actuating lever, said shaft component being formed of synthetic resin and having a spaced series of apertures in its upper end portion providing the means for connection to said lever connecting portion, said upper end portion of said shaft component being readily severable along the length of said spaced series of apertures therein for facile variation of the effective length of said shaft component.

5. The system of claim 4 wherein said first, generally rectilinear tubular portion is comprised of a pair of telescoping members which are sealingly engageable to permit variation in the axial length thereof.

6. The system of claim 4 wherein said shaft component and plunger component are integrally formed as a single piece.

7. The system of claim 4 wherein said first tubular portion of said conduit assembly has a cylindrical passageway therein at said intersection with said second tubular portion, and wherein said plunger component has an imperforate, generally cylindrical sidewall portion dimensioned and configured to sealingly engage within said passageway of said conduit assembly, to function as a plug therefor.

8. The system of claim 7 wherein said passageway and said sidewall portion of said plunger component are tapered slightly in the direction away from said one end of said first portion.

9. The system of claim 4 wherein said one end portion of said shaft component is bifurcated to provide a pair of parallel legs between which said connecting portion of said lever is pivotably engaged.

10. The system of claim 4 wherein said plunger component is a separate part, and is pivotably mounted upon said other end of said shaft component.

11. The system of claim 4 wherein said one end portion of said shaft component is bifurcated to provide a pair of parallel legs, said system additionally including an elongated extension member having an upper end portion connected to said connecting portion of said actuating lever, and having a tongue portion on its lower end engaged between said legs of said shaft component upper end portion and pivotably connected thereto, said extension member being made of a relatively rigid and yet resiliently deflectable synthetic resinous material.

12. The system of claim 11 wherein said extension member upper end portion is also bifurcated to provide parallel legs, said legs having holes therethrough providing a series of longitudinally extending, laterally aligned apertures for effecting said actuating lever connection.

* * * * *